US012698551B2

(12) United States Patent
Hirakawa et al.

(10) Patent No.: US 12,698,551 B2
(45) **Date of Patent: *Aug. 4, 2026**

(54) AUSTENITE STAINLESS STEEL SHEET, METHOD FOR PRODUCING SAME, AND SHEET SPRING

(71) Applicant: NIPPON STEEL STAINLESS STEEL CORPORATION, Tokyo (JP)

(72) Inventors: Naoki Hirakawa, Tokyo (JP); Yasushi Nishimura, Tokyo (JP)

(73) Assignee: NIPPON STEEL STAINLESS STEEL CORPORATION, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 18/707,671

(22) PCT Filed: Oct. 20, 2022

(86) PCT No.: PCT/JP2022/039182

§ 371 (c)(1),
(2) Date: May 6, 2024

(87) PCT Pub. No.: WO2023/105947

PCT Pub. Date: Jun. 15, 2023

(65) Prior Publication Data

US 2025/0003041 A1 Jan. 2, 2025

(30) Foreign Application Priority Data

Dec. 6, 2021 (JP) ..... 2021-198057

(51) Int. Cl.

| | |
|---|---|
| ***C21D 9/46*** | (2006.01) |
| ***C21D 6/00*** | (2006.01) |
| ***C21D 8/02*** | (2006.01) |
| ***C21D 8/0221*** | (2026.01) |
| ***C21D 8/0247*** | (2026.01) |
| ***C22C 38/00*** | (2006.01) |
| ***C22C 38/02*** | (2006.01) |
| ***C22C 38/04*** | (2006.01) |
| ***C22C 38/42*** | (2006.01) |
| ***C22C 38/44*** | (2006.01) |
| ***C22C 38/52*** | (2006.01) |
| *C21D 1/26* | (2006.01) |
| *C22C 38/06* | (2006.01) |
| *C22C 38/48* | (2006.01) |
| *C22C 38/50* | (2006.01) |

(52) U.S. Cl.

CPC ..... *C22C 38/44* (2013.01); *C21D 6/004* (2013.01); *C21D 8/02* (2013.01); *C21D 8/0226* (2013.01); *C21D 8/0236* (2013.01); *C21D 8/0263* (2013.01); *C21D 8/0268* (2013.01); *C21D 9/46* (2013.01); *C22C 38/001* (2013.01); *C22C 38/002* (2013.01); *C22C 38/02* (2013.01); *C22C 38/04* (2013.01); *C22C 38/42* (2013.01); *C22C 38/52* (2013.01); *C21D 1/26* (2013.01); *C21D 6/005* (2013.01); *C21D 8/0273* (2013.01); *C21D 2201/04* (2013.01); *C21D 2211/001* (2013.01); *C21D 2211/008* (2013.01); *C22C 38/005* (2013.01); *C22C 38/06* (2013.01); *C22C 38/48* (2013.01); *C22C 38/50* (2013.01)

(58) Field of Classification Search

CPC ..... C21D 9/46

See application file for complete search history.

(56) References Cited

U.S. PATENT DOCUMENTS

2012/0237388 A1* 9/2012 Sawada ..... C21D 6/004 72/200

FOREIGN PATENT DOCUMENTS

| | | | | |
|---|---|---|---|---|
| JP | 07090372 | A | | 4/1995 |
| JP | 10140294 | A | | 5/1998 |
| JP | 2002146483 | A | * | 5/2002 |
| WO | 2021230244 | A1 | | 11/2021 |

OTHER PUBLICATIONS

English machine translation of JP 2002-146483 A of Takano (Year: 2002).*

* cited by examiner

*Primary Examiner* — Jophy S. Koshy

(74) *Attorney, Agent, or Firm* — Greer, Burns & Crain, Ltd.

(57) ABSTRACT

An austenitic stainless steel sheet contains, on a mass basis, C: 0.04 to 0.11%, Si: 2.0 to 3.5%, Mn: 1.50% or less, Ni: 6.0 to 10.0%, Cr: 12.0 to 15.0%, Mo: 1.3 to 3.2%, Cu: 1.00% or less, N: 0.03 to 0.15%, and O: 0.0050% or less, the balance being Fe and impurities; wherein the austenitic stainless steel sheet has a value of $Md_{30}$ of −30.0 to 0° C., wherein the value of $Md_{30}$ is represented by the following equation (1):

$$Md_{30} = 551 - 462(C + N) - 9.2Si - 8.1Mn - 29(Ni + Cu) - 13.7Cr - 18.5Mo \quad (1)$$

in which the symbols of the elements each represents a content (% by mass) of each element. The austenitic stainless steel sheet has a metallographic structure having a content of a strain-induced martensite phase of 30% by volume or more, and has a thickness of 0.15 mm or less.

9 Claims, No Drawings

AUSTENITE STAINLESS STEEL SHEET, METHOD FOR PRODUCING SAME, AND SHEET SPRING

FIELD OF THE INVENTION

The present invention relates to an austenite stainless steel sheet, a method for producing the same, and a sheet spring.

BACKGROUND OF THE INVENTION

As communication devices such as smartphones and precision devices such as personal computers become smaller and more powerful, the structural and functional parts used in these devices are becoming thinner and lighter. Therefore, the materials used for these parts are required to have high strength even if they have a smaller thickness. Especially, in foldable smartphones (foldable phones) and other devices, sheet springs are used in back plates for supporting the folding function of LCD screens, and parts such as the sheet springs, which are exposed to repeated folding, are required to have fatigue properties that can withstand repeated folding.

As a material used for members such as sheet springs, Patent Literature 1 proposes an austenitic stainless steel sheet produced by cold-processing a stainless steel containing, in % by mass, C: 0.10% or less, Si: more than 1.0% to 4.0%, Mn: 2.0% or less, Ni: 4.0% to 10.0%, Cr: 12.0% to 18.0%, N: 0.15% or less, with C+N≥0.10%, such that an Md (N) value according to the equation: Md(N)=580−520C−2Si−16Mn−16Cr−23Ni−300N−26Cu−10Mo is in a range of 20 to 70, the balance being Fe and impurities inevitably contaminated during production, the stainless steel presenting a metastable austenite phase in a solutionized state, at a low temperature of −20° C. to 70° C. and at a reduction in thickness of 30 to 70% to transform a portion of the austenite phase into strain-induced martensite, and then subjecting it to an aging treatment at 300 to 650° C. for 0.1 to 90 minutes.

Further, as a material having excellent fatigue properties, Patent Literature 2 proposes an austenitic stainless steel sheet containing, in % by mass, C: 0.15% or less, Si: 1.0 to 4.0%, Mn: 5.0% or less, Ni: 4.0 to 10.0%, Cr: 12.0 to 18.0%, Cu: 0 to 3.5% (including a case of no addition), Mo: 1.0 to 5.0%, and N: 0.15% or less, the stainless steel sheet satisfying C+N≥0.10%, Si+Mo≥3.5%, and an Md (N) value defined by Md(N)=580−520×[% C]−2×[% Si]−16×[% Mn]−16×[% Cr]−23×[% Ni]−300×[% N]−26×[% Cu]−10×[% Mo] being from 20 to 100, the balance being Fe and inevitable impurity elements, wherein the steel sheet contains precipitates, the maximum size of the precipitates is 0.5 μm or less, and the tensile strength is 1800 N/mm$^2$ or more.

PRIOR ART

Patent Literatures

[PTL 1]
Japanese Patent Application Publication No. H07-90372 A

[PTL 2]
Japanese Patent Application Publication No. H10-140294 A

SUMMARY OF THE INVENTION

Problem to be Solved by the Invention

The austenitic stainless steel sheet described in each of Patent Literatures 1 and 2 cannot have sufficient strength when it has a smaller thickness (particularly when it has a thickness of 0.15 mm or less).

The present invention has been made to solve the above problems. An object of the present invention is to provide an austenitic stainless steel sheet which has high strength even if it has a small thickness, and which has improved fatigue properties, and to provide a method for producing the same.

Another object of the present invention is to provide a sheet spring which has high strength even if it has a small thickness, and which has a long life.

Means for Solving the Problem

As a result of intensive studies, the present inventors have found that the above problems can be solved by controlling the composition and metallographic structure of the austenitic stainless steel sheet, and have completed the present invention.

Thus, the present invention relates to an austenitic stainless steel sheet, wherein the austenitic stainless steel sheet comprises, on a mass basis, C: 0.04 to 0.11%, Si: 2.0 to 3.5%, Mn: 1.50% or less, Ni: 6.0 to 10.0%, Cr: 12.0 to 15.0%, Mo: 1.3 to 3.2%, Cu: 1.00% or less, N: 0.03 to 0.15%, and O: 0.0050% or less, the balance being Fe and impurities;

wherein the austenitic stainless steel sheet has a value of $Md_{30}$ of ~30.0 to 0° C., wherein the value of $Md_{30}$ is represented by the following equation (1):

$$Md_{30} = 551 - 462(C + N) - 9.2Si - 8.1Mn - 29(Ni + Cu) - 13.7Cr - 18.5Mo \quad (1)$$

in which the symbols of the elements each represents a content (% by mass) of each element;

wherein the austenitic stainless steel sheet has a metallographic structure having a content of a strain-induced martensite phase of 30% by volume or more; and wherein the austenitic stainless steel sheet has a thickness of 0.15 mm or less.

Also, the present invention relates to a method for producing an austenitic stainless steel sheet, the method comprising:

an intermediate rolling annealing step of subjecting a hot-rolled annealed sheet to stages of sequential cold rolling and annealing, the stages being repeated two or more times, wherein the hot-rolled annealed sheet has a composition comprising, on a mass basis, C: 0.04 to 0.11%, Si: 2.0 to 3.5%, Mn: 1.50% or less, Ni: 6.0 to 10.0%, Cr: 12.0 to 15.0%, Mo: 1.3 to 3.2%, Cu: 1.00% or less, N: 0.03 to 0.15%, and O: 0.0050% or less, the balance being Fe and impurities, wherein the hot-rolled annealed sheet has a value of $Md_{30}$ of −30.0 to 0° C., and wherein the value of $Md_{30}$ is represented by the following equation (1):

$$Md_{30} = 551 - 462(C + N) - 9.2Si - 8.1Mn - 29(Ni + Cu) - 13.7Cr - 18.5Mo \quad (1)$$

in which the symbols of the elements each represents a content (% by mass) of each element; and a temper rolling step of subjecting a cold-rolled annealed sheet obtained in the intermediate rolling annealing step to temper rolling at a reduction in thickness of 60% or more to adjust the thickness to 0.15 mm or less; and an aging treatment step of subjecting a temper-rolled sheet obtained in the temper rolling step under a condition where a value of B is 11500 to 15000, the B being represented by the following equation (2):

$$B = T(\log t + 20) \quad (2)$$

in which T is a temperature (K) and t is a time (h).

Further, the present invention relates to a sheet spring comprising the austenitic stainless steel sheet as described above.

Effects of the Invention

According to the present invention, it is possible to provide an austenitic stainless steel sheet which has high strength even if it has a small thickness, and which has improved fatigue properties, and to provide a method for producing the same.

Also, according to the present invention, it is possible to provide a sheet spring which has high strength even if it has a small thickness, and which has a long life.

DETAILED DESCRIPTION OF THE INVENTION

Hereinafter, embodiments of the present invention will be specifically described. It is to understand that the present invention is not limited to the following embodiments, and those which have appropriately added changes, improvements and the like to the following embodiments based on knowledge of a person skilled in the art without departing from the spirit of the present invention fall within the scope of the present invention.

It should be noted that, as used herein, the expression "%" in relation to any component means "% by mass", unless otherwise specified.

An austenitic stainless steel sheet according an embodiment of the present invention contains, on a mass basis, C: 0.04 to 0.11%, Si: 2.0 to 3.5%, Mn: 1.50% or less, Ni: 6.0 to 10.0%, Cr: 12.0 to 15.0%, Mo: 1.3 to 3.2%, Cu: 1.00% or less, N: 0.03 to 0.15%, and O: 0.0050% or less, the balance being Fe and impurities.

Here, the term "austenitic" refers to one having a metallographic structure that is mainly an austenite phase at ordinary temperature. Therefore, the "austenitic" includes those containing small amounts of phases other than the austenite phase (e.g., ferrite phase, martensite phase, etc.).

Further, the "impurities" means components which are contaminated due to various factors such as raw materials such as ore and scrap, and production steps, when the austenitic stainless steel sheet is industrially produced, and which are acceptable in a range that does not adversely affect the present invention. For example, those impurities also include inevitable impurities such as P and S, which are difficult to be removed.

Furthermore, with regard to the content of each element as used herein, containing "xx % or less" means containing an amount that is xx % or less but exceeds 0% (especially more than the impurity level).

Further, the austenitic stainless steel sheet according to an embodiment of the present invention can further contain one or more selected from: Co: 0.05 to 0.50%, Al: 0.15% or less, V: 0.0001 to 0.5000%, Ti: 0.01 to 0.50%, B: 0.0001 to 0.0150%, Nb: 0.001 to 0.100%, Mg: 0.0001 to 0.0030%, Ca: 0.0003 to 0.0100%, Sn: 0.001 to 0.500%, Pb: 0.0001 to 0.0100%, W: 0.0001 to 0.5000%, Zr: 0.0001 to 0.1000%, and REM: 0.0001 to 0.3000%, if necessary. Therefore, the austenitic stainless steel sheet according to an embodiment of the present invention can be expressed as having a composition containing C: 0.04 to 0.11%, Si: 2.0 to 3.5%, Mn: 1.50% or less, Ni: 6.0 to 10.0%, Cr: 12.0 to 15.0%, Mo: 1.3 to 3.2%, Cu: 1.00% or less, N: 0.03 to 0.15%, and O: 0.0050% or less, and further containing one or more selected from: Co: 0.05 to 0.50%, Al: 0 to 0.15%, V: 0.0001 to 0.5000%, Ti: 0.01 to 0.50%, B: 0.0001 to 0.0150%, Nb: 0.001 to 0.100%, Mg: 0.0001 to 0.0030%, Ca: 0.0003 to 0.0100%, Sn: 0.001 to 0.500%, Pb: 0.0001 to 0.0100%, W: 0.0001 to 0.5000%, Zr: 0.0001 to 0.1000%, and REM: 0.0001 to 0.3000%, the balance being Fe and impurities.

Here, with regard to the content of each element as used herein, containing "0 to xx %" means containing an amount that is xx % or less but including 0% (i.e., the case where it is not contained).

Each component will be described below in detail.

<C: 0.04 to 0.11%>

The C is an intrusion-type element and contributes to high strength by work hardening and aging treatment. Further, the C is an element that stabilizes the austenite phase and is also effective for maintaining non-magnetism. However, if the C content is too high, it becomes hard and causes a decrease in cold workability. Therefore, the upper limit of the C content is set to 0.11%, and preferably 0.10%, and more preferably 0.09%. On the other hand, the lower limit of the C content is preferably set to 0.04%, and more preferably 0.05%, and even more preferably 0.06%, in terms of refining costs.

<Si: 2.0 to 3.5%>

The Si is an element used as a deoxidizing agent for stainless steel in the steelmaking process. Further, the Si also has a function of improving hardening properties in an aging treatment. However, since the Si has a higher solid solution strengthening function and has an action of decreasing stacking fault energy to improve work hardening, an excessively high Si content will be a factor of decreasing cold workability. Therefore, the upper limit of the Si content is set to 3.5%, and preferably 3.3%, and more preferably 3.0%. On the other hand, the lower limit of the Si content is preferably set to 2.0%, and more preferably 2.1%, and even more preferably 2.2%, in view of ensuring the above effect.

<Mn: 1.50% or Less>

The Mn is an element that forms oxide-based inclusions as MnO. Further, the Mn has a lower solid solution strengthening function and is an austenite-forming element, and has a function of suppressing strain-induced martensitic transformation. Therefore, the upper limit of the Mn content is set to 1.50%, and preferably 1.40%, and more preferably 1.30%. On the other hand, the lower limit of the Mn content is not particularly limited, but it may preferably be set to 0.01%, and more preferably 0.05%, and even more preferably 0.10%.

<Ni: 6.0 to 10.0%>

The Ni is an element contained to obtain an austenite phase at an elevated temperature and room temperature. It is necessary to contain Ni in order to form a metastable austenite phase at room temperature and to allow the martensite phase to be induced during cold rolling. If the Ni content is too low, 5 ferrite phases are formed at an elevated temperature, and the martensite phases are also formed in the cooling process to the room temperature, which will not allow any austenite monophase to be present. Therefore, the lower limit of the Ni content is set to 6.0%, and preferably 6.3%, and more preferably 6.5%. On the other hand, if the Ni content is too high, the martensite phase is difficult to be induced during the cold rolling. Therefore, the upper limit of the Ni content is set to 10.0%, and preferably 9.5%, and more preferably 9.0%.

<Cr: 12.0 to 15.0%>

The Cr is an element that improves corrosion resistance of the austenitic stainless steel sheet. From the viewpoint of ensuring corrosion resistance suitable for structural parts and functional parts (particularly sheet springs), the lower limit of the Cr content is set to 12.0%, and preferably 12.5%, and more preferably 13.0%. On the other hand, if the Cr content is too high, the cold workability is deteriorated. Therefore, the upper limit of the Cr content is set to 15.0%, and preferably 14.8%, and more preferably 14.5%.

<Mo: 1.3 to 3.2%>

The Mo is an effective element for improving the corrosion resistance of the austenitic stainless steel sheet. The Mo is also an element effective for suppressing the release of strain generated during cold rolling. In view of the recent use in structural parts and functional parts (particularly sheet springs) for which improvement in corrosion resistance and fatigue properties is required, the lower limit of the Mo content is set to preferably 1.3%, and more preferably 1.5%, and even more preferably 1.7%. On the other hand, since Mo is expensive, an excessively high Mo content will lead to an increase in production cost. Further, the 5-ferrite phase and the α-ferrite phase are generated at an elevated temperature. Therefore, the upper limit of the Mo content is set to 3.2%, and preferably 3.0%, and more preferably 2.8%.

<Cu: 1.00% or Less>

The Cu is an element that has a function of hardening the stainless steel during the aging treatment. However, if the Cu content is too high, the hot workability is deteriorated, which will cause cracking. Therefore, the upper limit of the Cu content is set to 1.00%, and preferably 0.90%, and more preferably 0.80%. On the other hand, the lower limit of the Cu content is not particularly limited, but it may preferably be set to 0.01%, and more preferably 0.02%, and even more preferably 0.03%.

<N: 0.03 to 0.15%>

The N is an austenite-forming element. Further, the N is an extremely effective element for hardening the austenite phase and the martensite phase. However, an excessively high N content will cause blow holes during casting. Therefore, the upper limit of the N content is set to 0.15%, and preferably 0.13%, and more preferably 0.12%. On the other hand, the lower limit of the N content is preferably set to 0.03%, and preferably 0.05%, in terms of ensuring the above effects of N.

<O: 0.0050% or Less>

If the O content is too high, coarse inclusions having an average diameter of more than 5 μm tends to be formed. Therefore, the upper limit of the O content is preferably set to 0.0050%, and preferably 0.0045%, and more preferably 0.0040%. On the other hand, the lower limit of the O content is not particularly limited. However, if the O content is too low, it will be difficult to oxidize Mn, Si and the like, so that a ratio of $Al_2O_3$ in the inclusions will be increased. Therefore, the lower limit of the O content is preferably set to 0.0001%, and more preferably 0.0010%, and even more preferably 0.0020%.

<Co: 0.05 to 0.50%>

The Co is an element optionally contained in the austenitic stainless steel sheet. The Co has an effect of improving crevice corrosion resistance. From the viewpoint of exerting such an effect, the lower limit of the Co content is preferably set to 0.05%, and more preferably 0.08%, and even more preferably 0.10%. On the other hand, if the Co content is too high, the austenitic stainless steel sheet becomes hard to deteriorate the ductility. Therefore, the upper limit of the Co content may be set to preferably 0.50%, and more preferably 0.40%, and even more preferably 0.3%.

<Al: 0.15% or Less>

The Al is an element optionally contained in the austenitic stainless steel sheet. The Al has a higher oxygen affinity than Si and Mn. If the Al content is too high, coarse oxide-based inclusions, which function as starting points of internal cracks, are prone to be formed in cold rolling. Therefore, the upper limit of the Al content is preferably set to 0.15%, and more preferably 0.13%. On the other hand, the lower limit of the Al content is not particularly limited. However, an excessively low Al content will lead to an increase in production cost. Therefore, it may preferably be set to 0.01%, and more preferably 0.03%, and even more preferably 0.05%.

<V: 0.0001 to 0.5000%>

The V is an element optionally contained in the austenitic stainless steel sheet. The V is an element having a function of enhancing aging hardening properties in the aging treatment. From the viewpoint of sufficiently producing such a function, the lower limit of the V content is preferably set to 0.0001%, and more preferably 0.0010%. On the other hand, an excessively high V content will lead to an increase in production cost. Therefore, the upper limit of the V content may preferably be set to 0.5000%, and more preferably 0.4800%, and even more preferably 0.4500%.

<Ti: 0.01 to 0.50%>

The Ti is an element optionally contained in the austenitic stainless steel sheet. The Ti is a carbonitride-forming element, and fixes C and N, and suppresses deterioration of corrosion resistance due to sensitization. From the viewpoint of exerting such an effect, the lower limit of the Ti content may preferably be set to 0.01%, and more preferably 0.03%, and even more preferably 0.05%. On the other hand, if the Ti content is too high, an amount of solid solution of C and N will decrease, and it may be heterogeneously localized and precipitated as a carbide, which may inhibit the growth of recrystallized grains. Moreover, the Ti is expensive, which will lead to an increase in production cost. Therefore, the upper limit of the Ti content may be set to preferably 0.50%, and more preferably 0.40%, and even more preferably 0.30%.

<B: 0.0001 to 0.0150%>

The B is an element optionally contained in the austenitic stainless steel sheet. An excessively high B content causes a decrease in workability due to the generation of boride. Therefore, the upper limit of the B content may be set to preferably 0.0150%, and more preferably 0.0100%. On the other hand, the lower limit of the B content is not particularly limited, but it may preferably be set to 0.0001%, and more preferably 0.0002%.

<Nb: 0.001 to 0.100%>

The Nb is an element optionally contained in the austenitic stainless steel sheet. The Nb is an element having a high affinity to C and N, and has effects of precipitating as a carbide or a nitride during hot rolling, and of reducing solid solution C and solid solution N in the matrix phase to improve the workability. From the viewpoint of exerting such effects, the lower limit of the Nb content may be set to preferably 0.001, and more preferably 0.005%. On the other hand, if the Nb content is too high, the austenitic stainless steel sheet becomes hard to deteriorate the ductility. Therefore, the upper limit of the Nb content may be set to preferably 0.100%, and more preferably 0.050%.

<Mg: 0.0001 to 0.0030%>

The Mg is an element optionally contained in the austenitic stainless steel sheet. The Mg forms Mg oxide together with Al in a molten steel and acts as a deoxidizing agent. From the viewpoint of exerting such an action, the lower limit of the Mg content may be set to preferably 0.0001%, and more preferably 0.0005%. On the other hand, if the Mg content is too high, the toughness of the austenitic stainless steel sheet will decrease. Therefore, the upper limit of the Mg content may preferably be set to 0.0030%, and more preferably 0.0020%.

<Ca: 0.0003 to 0.0100%>

The Ca is an element optionally contained in the austenitic stainless steel sheet. The Ca is an element that improves hot workability. From the viewpoint of exerting such an effect of Ca, the lower limit of the Ca content may be set to preferably 0.0003%, and more preferably 0.0005%. On the other hand, if the Ca content is too high, the toughness of the austenitic stainless steel sheet will decrease. Therefore, the upper limit of the Ca content may be set to preferably 0.0100%, and more preferably 0.0050%.

<Sn: 0.001 to 0.500%>

The Sn is an element optionally contained in the austenitic stainless steel sheet. The Sn has an effect of improving the workability by promoting the formation of a deformed zone during rolling. From the viewpoint of exerting such an effect of Sn, the lower limit of the Sn content may be set to preferably 0.001%, and more preferably 0.003%. On the other hand, if the Sn content is too high, the effect of Sn is saturated and the workability is deteriorated. Therefore, the upper limit of the Sn content may be set to preferably 0.500%, and more preferably 0.200%.

<Pb: 0.0001 to 0.0100%>

The Pb is an element optionally contained in the austenitic stainless steel sheet. The Pb has an effect of improving free-cutting properties. From the viewpoint of exerting such an effect of Pb, the lower limit of the Pb content may be set to preferably 0.0001%, and more preferably 0.0005%. On the other hand, an excessively high Pb content will decrease a melting point of grain boundaries and lowers the bonding force of the grain boundaries, so that there is a concern that the hot workability may be deteriorated such as liquefaction cracking due to the melting of the grain boundaries. Therefore, the upper limit of the Pb content may be set to preferably 0.0100%, and more preferably 0.0080%.

<W: 0.0001 to 0.5000%>

The W is an element optionally contained in the austenitic stainless steel sheet. The W has an action of improving the strength at an elevated temperature without impairing the ductility at room temperature. From the viewpoint of exerting such an effect of W, the lower limit of the W content may be set to preferably 0.0001%, and more preferably 0.0005%. On the other hand, if the W content is too high, coarse eutectic carbides are formed, causing a decrease in ductility. Therefore, the upper limit of the W content may be set to preferably 0.5000%, and more preferably 0.4500%.

<Zr: 0.0001 to 0.1000%>

The Zr is an element optionally contained in the austenitic stainless steel sheet. The Zr is an element having a high affinity to C and N, and has effects of precipitating as a carbide or a nitride during hot rolling, and of reducing solid solution C and solid solution N in the matrix phase to improve the workability. From the viewpoint of exerting such effects, the lower limit of the Zr content may be set to preferably 0.0001%, and more preferably 0.0005%. On the other hand, if the Zr content is too high, the austenitic stainless steel sheet becomes hard to deteriorate the ductility. Therefore, the upper limit of the Zr content may be set to preferably 0.1000%, and more preferably 0.0500%.

<REM: 0.0001 to 0.3000%>

The REM is an element optionally contained in the austenitic stainless steel sheet. The REM (elements with atomic numbers 21, 39, 57 to 71, such as La, Ce, and Nd) has an effect of improving oxidation resistance at elevated temperature. From the viewpoint of exerting such an effect of REM, the lower limit of the REM content may be set to preferably 0.0001%, and more preferably 0.0010%. On the other hand, if the REM content is too high, the effect of REM will be saturated, and surface defects will occur during hot rolling, resulting in reduced productivity. Therefore, the upper limit of the REM content may be set to preferably 0.3000%, and more preferably 0.1000%, and still more preferably 0.0500%. The REM may use a single element or may use a combination of a plurality of different elements.

<$Md_{30}$: −30.0 to 0° C.>

The $Md_{30}$ represents a temperature (° C.) at which 50% of the structure is transformed into martensite when a strain of 0.30 is applied to the austenite (γ) monophase. Therefore, it means that as the $Md_{30}$ is higher (higher temperature), the austenite is more unstable.

The $Md_{30}$ is represented by the following equation (1):

$$Md_{30} = 551 - 462(C + N) - 9.2Si - 8.1Mn - 29(Ni + Cu) - 13.7Cr - 18.5Mo \quad (1)$$

In the equation, the symbols of the elements each represents a content (% by mass) of each element.

If the $Md_{30}$ is too low, the stability of the austenite phase will increase, and it will be difficult to transform the austenite phase into the strain-induced martensite phase by cold rolling, so that the strength cannot be sufficiently increased. Therefore, the lower limit of the $Md_{30}$ is set to ~30.0° C. On the other hand, if the $Md_{30}$ is too high, the austenite phase becomes unstable and an amount of the strain-induced martensite phase transformed by cold rolling increases, as well as it will be difficult to control a dislocation density of each phase as described below to a desired range, so that desired ductility and fatigue properties cannot be obtained. Therefore, the upper limit of the $Md_{30}$ is set to 0° C.

The austenitic stainless steel sheet according to the embodiment of the present invention has a metallographic structure in which a content of a strain-induced martensite phase is 30.0% by volume or more. By controlling the content of the strain-induced martensite phase to such a range, the strength and fatigue properties of the austenitic stainless steel sheet can be improved. Moreover, from the viewpoint of stably obtaining this effect, the content of the strain-induced martensite phase may preferably be 30.5% by volume or more, and more preferably 31.0% by volume or more. The upper limit of the content of the strain-induced martensite phase is not particularly limited, but it may preferably be 70.0% by volume, and more preferably 65.0% by volume.

Here, the content of the strain-induced martensite phase can be measured using a method known in the technical field. For example, the content of the strain-induced martensite phase may be measured using a ferrite scope or the like.

The austenitic stainless steel plate according to the embodiment of the present invention preferably has an average grain size of 15.0 μm or less. By controlling the average grain size to such a range, it becomes easier to improve the strength and fatigue properties of the austenitic stainless steel sheet. From the viewpoint of stably obtaining this effect, the average crystal grain size is more preferably 12.0 μm or less, and still more preferably 10.0 μm or less. It should be noted that the lower limit of the average crystal grain size is not particularly limited, but it may preferably be 1.0 μm, and more preferably 3.0 μm.

Here, the average crystal grain size can be measured in accordance with JIS G 0551: 2020.

The austenitic stainless steel sheet according to the embodiment of the present invention preferably has a dislocation density of a retained austenite phase of $0.40\times10^{16}$ $m^{-2}$ or more. By controlling the dislocation density of the retained austenite phase to such a range, the strength and fatigue strength of the austenitic stainless steel sheet can be stably improved. On the other hand, if the dislocation density of the retained austenite phase is less than $0.40\times10^{16}$ $m^{-2}$, dislocation motion in the phase cannot be sufficiently suppressed, and strength and fatigue strength may decrease. The upper limit of the dislocation density of the retained austenite phase is not particularly limited, but it may preferably be $5.0\times10^{16}$ $m^{-2}$, and more preferably $3.0\times10^{16}$ $m^{-2}$, and even more preferably $2.0\times10^{16}$ $m^{-2}$.

Here, the dislocation density refers to the total length of dislocations contained in crystal per unit volume. In general, the cold rolling results in accumulation of some of the moved dislocations in the material, so that the dislocation density increases. The dislocations thus accumulated interact with subsequent dislocations to impede the movement of the dislocations, so that an increase in dislocation density improves the strength and fatigue properties. It should be noted that the dislocation density of the retained austenite phase can be calculated by line profiling analysis of the shape of a diffraction peak measured by X-ray diffraction.

The austenitic stainless steel sheet according to the embodiment of the present invention may contain inclusions having an average diameter of 1.5 μm or less. Coarse inclusions cause a decrease in the strength and fatigue strength of the austenitic stainless steel sheet, but fine inclusions having an average diameter of 1.5 μm or less can suppress an impact on the strength and fatigue strength of the austenitic stainless steel sheet.

As used herein, the term "inclusions" refer to non-metallic compounds such as oxides and sulfides.

The number of the inclusions contained in the austenitic stainless steel sheet according to the embodiment of the present invention is preferably 1000 inclusions/$mm^2$ or less. By controlling the number of the inclusions to such a range, it becomes easier to stably improve the strength and fatigue strength of the austenitic stainless steel sheet. From the viewpoint of stably obtaining this effect, the number of the inclusions is more preferably 980 inclusions/$mm^2$ or less, and still more preferably 960 inclusions/$mm^2$ or less. It should be noted that since it is preferable that the number of the inclusions be small, the lower limit of the number of the inclusions is not particularly limited.

Here, the number of the inclusions can be determined by a point counting method in accordance with JIS G 0555: 2020.

The austenitic stainless steel sheet according to the embodiment of the present invention preferably has a tensile strength (TS) of 2200 MPa or more, and more preferably 2250 MPa or more. By controlling the tensile strength to such a range, the strength of the austenitic stainless steel sheet can be ensured. The upper limit of the tensile strength is not particularly limited, but it may typically be 3000 MPa, and preferably 2500 MPa.

Here, the tensile strength of the austenitic stainless steel sheet can be measured in accordance with JIS Z 2241: 2011.

The austenitic stainless steel sheet according to an embodiment of the present invention preferably has an elongation at brake (EL) of 0.5% or more, and more preferably 1.0% or more, and even more preferably 1.5%. By controlling the elongation at break to such a range, the ductility of the austenitic stainless steel sheet can be ensured. The upper limit of the elongation at break is not particularly limited, but it may typically be 10.0%, and preferably 5.0%. Here, the elongation at break of the austenitic stainless steel sheet can be measured in accordance with JIS Z 2241: 2011.

In the austenitic stainless steel sheet according to the embodiment of the present invention, the fold number as measured in accordance with JIS P 8115: 2001 is preferably 1100 or more, and more preferably 1120 or more, and still more preferably 1130. If the fold number is in this range, it can be said that the austenitic stainless steel sheet has excellent fatigue strength. It should be noted that the higher the hold number, the better the fatigue strength, so the upper limit is not particularly limited.

Here, the hold number can be measured in accordance with JIS P 8115: 2001, as described above.

The austenitic stainless steel sheet according to the embodiment of the present invention has a thickness of 0.15 mm or less, and preferably 0.12 mm or less, more preferably 0.10 mm or less, and still more preferably 0.08 mm or less. With such a thickness, various parts can be made thinner and lighter. It should be noted that the lower limit of the thickness is generally 0.01 mm, although it is not particularly limited as long as it may be adjusted depending on the application.

The method for producing the austenitic stainless steel sheet according to the embodiment of the present invention is not particularly limited as long as it is a method that can provide an austenitic stainless steel sheet having the above features. For example, a typical method for producing an austenitic stainless steel sheet according to the embodiment of the present invention includes an intermediate rolling annealing step, a temper rolling step, and an aging treatment step.

The intermediate rolling annealing step is a step of subjecting the hot-rolled annealed sheet having the above composition to stages of sequential cold rolling and annealing, which are repeated two or more times. By performing the intermediate rolling annealing step, grains can be refined by generating the strain-induced martensite phase and then undergoing reverse transformation, so that the strength can be improved.

The hot-rolled annealed sheet can be produced by smelting stainless steel having the above composition, then forging or casting it, then hot-rolling it, and then annealing it. The conditions for hot rolling and annealing are not particularly limited and may be adjusted as needed depending on the composition of the stainless steel. It should be noted that after annealing, pickling or the like may be performed as necessary.

The stages of sequential cold rolling and annealing are repeated two or more times. For example, when performing this stage three times, the order is as follows: cold rolling, annealing, cold rolling, annealing, cold rolling, and annealing. Therefore, even if the number of stages is increased, the first stage is cold rolling and the last stage is annealing. The upper limit of the number of the stages is not particularly limited, but it may generally be 10, preferably 5.

The conditions for cold rolling in each stage are not particularly limited as long as they can be adjusted as needed depending on the composition of the stainless steel, but a reduction in thickness for each of two or more cold rolling processes is preferably 50% or more, and more preferably 55% or more, and even more preferably 60% or more, and still more preferably 60% or more. By controlling each reduction in thickness to such a range, grains can be easily refined. It should be noted that the upper limit value of each reduction in thickness is not particularly limited, but it may be, for example, 80% or 90%.

Similarly, the annealing conditions in each step are not particularly limited as long as they may be adjusted as needed depending on the composition of the stainless steel, but each annealing temperature is preferably 900° C. or more, and more preferably 950° C. or more, and even more preferably 1000° C. or more. By controlling the temperature to such a range, crystal grains can be easily refined. Further, the annealing temperature in each stage may be the same or different. It should be noted that the upper limit of each annealing temperature is not particularly limited, but it may be, for example, 1200° C. or 1300° C.

Further, each annealing time may be adjusted as appropriate depending on each annealing temperature, and it is, for example, 10 to 300 seconds.

The temper rolling step is a step of subjecting the cold-rolled annealed plate obtained in the intermediate rolling annealing step to temper rolling at a reduction in thickness of 60% or more to adjust the thickness to 0.15 mm or less. By performing the temper rolling step, strain can be accumulated in the austenite phase and a certain amount of the strain-induced martensite phase can be ensured, so that the strength can be improved.

From the viewpoint of stably obtaining the above effects, the reduction in thickness of temper rolling is preferably 62% or more, and more preferably 65% or more. The upper limit of the reduction in thickness is, for example, 80% or 90%, although it is not particularly limited.

The aging treatment step is a step of subjecting the temper-rolled sheet obtained in the temper rolling step to an aging treatment under predetermined conditions. The aging treatment is performed under conditions where a B value represented by the following equation (2) is 11500 to 15000:

$$B = T(\log t + 20) \tag{2}$$

(In the equation, T is temperature (K) and t is time (h)). By performing the aging treatment under such conditions, the strength can be improved by precipitation hardening due to the austenite phase (γ phase).

The B value is preferably 12,000 to 14,800, and more preferably 12,500 to 14,500, and even more preferably 13,000 to 14,000, from the viewpoint of stably obtaining the above effects. Further, the temperature and time of the aging treatment are not particularly limited as long as the above conditions are met, but the typical temperature is 300 to 700° C. and the typical time is 5 to 500 seconds.

The austenitic stainless steel sheet according to the embodiment of the present invention has high strength, and has improved fatigue properties. Therefore, it can be used for various parts that are required to reduce the thickness and weight, for example, structural parts and functional parts in communication devices such as smartphones and precision devices such as personal computers. In particular, the austenitic stainless steel sheet according to the embodiment of the present invention is suitable for use in sheet springs used in back plates that support the folding function of LCD screens in foldable smartphones and the like.

EXAMPLES

Hereinafter, the present invention will be described in detail with reference to Examples. However, it should not be construed that the present invention is limited to those Examples.

30 kg of stainless steel having each composition shown in Table 1 was smelted by vacuum melting, forged into a sheet shape with a thickness of 30 mm, and then heated at 1230° C. for 2 hours to obtain a hot-rolled sheet having each thickness shown in Table 2. The hot-rolled sheet was then annealed and pickled to obtain a hot-rolled annealed sheet, and then the hot-rolled annealed sheet was subjected to an intermediate rolling annealing step, a temper rolling step, and an aging treatment step in this order, to obtain an austenitic stainless steel sheet. Table 2 shows the conditions for the intermediate rolling annealing step, the temper rolling step, and the aging treatment step. In addition, each annealing condition in the intermediate rolling annealing step was 1050° C. for 60 seconds.

| Steel | Composition (% by mass) | | | | | | | | | | $Md_{30}$ |
|---|---|---|---|---|---|---|---|---|---|---|---|
| Nos. | C | Si | Mn | Ni | Cr | Mo | Cu | N | O | Other | (° C.) |
| 1 | 0.08 | 2.7 | 0.22 | 8.3 | 13.6 | 2.3 | 0.11 | 0.07 | 0.0027 | — | −17 |
| 2 | 0.06 | 2.2 | 0.80 | 8.5 | 14.2 | 1.9 | 0.20 | 0.06 | 0.0033 | Al: 0.08<br>Nb: 0.021<br>Pb: 0.0010 | −13 |
| 3 | 0.09 | 2.8 | 1.20 | 6.6 | 13.6 | 2.5 | 0.55 | 0.08 | 0.0025 | V: 0.0300<br>Mg: 0.0020<br>Ca: 0.0050 | −3 |
| 4 | 0.09 | 2.6 | 0.23 | 8.2 | 13.2 | 2.1 | 0.09 | 0.11 | 0.0035 | Co: 0.22<br>Ti: 0.08<br>W: 0.1300 | −27 |
| 5 | 0.08 | 2.5 | 0.25 | 8.4 | 13.4 | 1.9 | 0.13 | 0.09 | 0.0031 | Al: 0.11<br>B: 0.0031<br>Sn: 0.230 | −19 |
| 6 | 0.09 | 2.8 | 0.25 | 8.5 | 13.3 | 2.4 | 0.15 | 0.07 | 0.0029 | Co: 0.21<br>V: 0.0400 | −28 |

-continued

| Steel | Composition (% by mass) | | | | | | | | | | $Md_{30}$ |
|---|---|---|---|---|---|---|---|---|---|---|---|
| Nos. | C | Si | Mn | Ni | Cr | Mo | Cu | N | O | Other | (° C.) |
| | | | | | | | | | | Zr: 0.0010<br>REM: 0.030 | |
| 7 | 0.09 | 0.6 | 1.00 | 6.4 | 17.3 | 0.4 | 0.26 | 0.03 | 0.0034 | — | 44 |
| 8 | 0.08 | 1.9 | 0.39 | 6.5 | 14.5 | 2.3 | 2.56 | 0.07 | 0.0019 | — | −43 |
| 9 | 0.08 | 2.5 | 0.25 | 8.2 | 13.4 | 2.4 | 0.12 | 0.09 | 0.0059 | Co: 0.21 | −22 |

Underlines indicate that they are outside the scope of the present invention.

| | | Thickness of Hot | Intermediate Rolling Annealing Step | | Temper | | | | |
|---|---|---|---|---|---|---|---|---|---|
| | | Rolled | Number | Each | Rolling Step | | Aging Treatment Step | | |
| | Steel Nos. | Sheet (mm) | of Stages (times) | Reduction (%) | Reduction (%) | Thickness (mm) | Temperature (° C.) | Time (s) | B |
| Ex. 1 | 1 | 3.5 | 3 | 65 | 67 | 0.05 | 500 | 15 | 13620 |
| Ex. 2 | 2 | 3.5 | 3 | 65 | 67 | 0.05 | 500 | 15 | 13620 |
| Ex. 3 | 3 | 3.5 | 3 | 65 | 67 | 0.05 | 500 | 15 | 13620 |
| Ex. 4 | 4 | 3.5 | 3 | 65 | 67 | 0.05 | 500 | 15 | 13620 |
| Ex. 5 | 5 | 3.5 | 3 | 65 | 67 | 0.05 | 500 | 15 | 13620 |
| Ex. 6 | 6 | 3.5 | 3 | 65 | 67 | 0.05 | 500 | 15 | 13620 |
| Ex. 7 | 1 | 1.2 | 2 | 65 | 67 | 0.05 | 500 | 15 | 13620 |
| Ex. 8 | 1 | 3.5 | 3 | 65 | 67 | 0.05 | 550 | 50 | 14931 |
| Ex. 9 | 1 | 3.5 | 3 | 65 | 67 | 0.05 | 400 | 60 | 12263 |
| Ex. 10 | 1 | 3.5 | 3 | 65 | 60 | 0.06 | 500 | 15 | 13620 |
| Ex. 11 | 1 | 3.7 | 3 | 65 | 75 | 0.04 | 500 | 15 | 13620 |
| Comp. 1 | 7 | 3.5 | 3 | 65 | 67 | 0.05 | 500 | 15 | 13620 |
| Comp. 2 | 8 | 3.5 | 3 | 65 | 67 | 0.05 | 500 | 15 | 13620 |
| Comp. 3 | 1 | 8.7 | 1 | 65 | 67 | 1.00 | 500 | 15 | 13620 |
| Comp. 4 | 1 | 6.9 | 1 | 65 | 67 | 0.80 | 500 | 15 | 13620 |
| Comp. 5 | 1 | 3.5 | 3 | 65 | 67 | 0.05 | 200 | 600 | 9092 |
| Comp. 6 | 1 | 3.5 | 3 | 65 | 67 | 0.05 | 600 | 30 | 15645 |
| Comp. 7 | 1 | 3.5 | 3 | 65 | 53 | 0.07 | 500 | 15 | 13620 |
| Comp. 8 | 9 | 3.5 | 3 | 65 | 67 | 0.05 | 500 | 15 | 13620 |

Underlines indicate that they are outside the scope of the present invention.

The following evaluations were performed on each austenitic stainless steel sheet obtained as described above.

<Average Grain Size>

The average crystal grain size was determined by a comparative method in accordance with JIS G 0551: 2020. The surface for observing the average grain size was obtained by electrolytically polishing the surface of each austenitic stainless steel sheet to obtain a mirror finished surface, which was then etched with aqua regia.

<Content of Strain-Induced Martensite Phase)

A sample was cut out from each of austenitic stainless steel sheets, and a content of strain-induced martensite was measured using a ferrite scope (FERITESCOPE MP30E-S from Fisher). The measurement was carried out at arbitrary three points on the surface of the sample, and an average value thereof was used as the results. Hereinafter, the strain-induced martensite phase may be abbreviated as "M Phase".

<Dislocation Density of Retained Austenite Phase>

The dislocation density of the retained austenite phase was calculated by line profiling analysis of the shape of the diffraction peak measured by X-ray diffraction. In the dislocation-introduced structure, lattice strain occurs around the dislocation, and the arrangement of the dislocation develops low-angle grain boundaries and cell structures. By capturing these with X-rays, the dislocation density can be calculated.

A sample was cut from each austenitic stainless steel sheet at any position and subjected to mechanical polishing and chemical polishing. The surface structure of the sample was subjected to X-ray diffraction, and a dislocation density p was calculated from a single diffraction peak of {111} of the retained austenite phase. The following equation (3) was used to calculate the dislocation density p.

$$\rho = \left[3(2\pi)^{1/2} < \varepsilon^2 >^{1/2}\right]/Db \tag{3}$$

in which $<\varepsilon^2>$ is a root-mean-square strain, D is a crystallite size, and b is a Burgers vector.

Also, the root-mean-square strain $<\varepsilon^2>$ and the crystallite size D used in the equation (3) were determined from the following equation (4):

$$-\ln A(L)/L = 1/D + \left[-1/(2D^2) + 2\pi^2 < \varepsilon^2 > h_0^2/a^2\right]L \tag{4}$$

in which InA(L) is a logarithm of a Fourier coefficient of a line profile of each diffraction peak, L is a Fourier length, $h_0^2=h^2+k^2+l^2$ (h, k, and l are plane indices of the diffraction peaks used), and a is a lattice constant. With −InA(L)/L on the vertical axis and L on the horizontal axis, D was determined from the y-intercept 1/D of the plot, and $<\varepsilon^2>$ was determined from the slope $[-1/(2D^2)+2\pi^2<\varepsilon^2>h_0^2/a^2]$.

Further, an X-ray diffractometer (from Rigaku Corporation) was used as the analyzer, and a Cu dry bulb was used as the target. In addition, hereinafter, the retained austenite phase may be abbreviated as "γ phase".

<Average Diameter and Number of Inclusions>

The average diameter and the number of inclusions were determined by the point counting method in accordance with JIS G 0555: 2020. The surface on which the inclusions were observed was obtained by electrolytically polishing the surface of each austenitic stainless steel sheet to obtain a mirror finished surface.

<Tensile Strength (TS) and Elongation at Break (EL)>

A JIS 13 B sample was cut out from each of the austenitic stainless steel sheets, and the measurement was carried out using this sample in accordance with JIS Z 2241: 2011.

<Fold Number>

The fold number was measured in accordance with JIS P 8115: 2001.

The fold number was measured using a sample having a size of 15 mm (width direction)×130 mm (rolling direction) under the following conditions:

Load: 0.25 kgf;

Test speed: 175 cpm;

Folding angle: 135°;

R of folding clamp: 2.0 mm; and

Opening of folding clamp: 0.25 mm.

Table 3 shows the above evaluation results.

| | Average Grain Size (μm) | M phase Content (% by volume) | γ phase Dislocation Density ($\times 10^{16} m^{-2}$) | Inclusions Average Diameter (μm) | Inclusions Number ($/mm^2$) | TS (Mpa) | EL (%) | Fold Number (times) |
|---|---|---|---|---|---|---|---|---|
| Ex. 1 | 7.1 | 34.8 | 0.42 | 1.1 | 705 | 2401 | 1.8 | 1502 |
| Ex. 2 | 8.5 | 36.8 | 0.44 | 1.3 | 850 | 2336 | 1.9 | 1145 |
| Ex. 3 | 6.8 | 42.1 | 0.45 | 1.2 | 606 | 2295 | 2.1 | 1532 |
| Ex. 4 | 8.2 | 31.5 | 0.45 | 1.1 | 823 | 2378 | 1.8 | 1311 |
| Ex. 5 | 7.2 | 33.8 | 0.45 | 0.9 | 921 | 2368 | 1.9 | 1402 |
| Ex. 6 | 6.9 | 30.6 | 0.41 | 1.1 | 754 | 2361 | 2.1 | 1445 |
| Ex. 7 | 9.3 | 32.1 | 0.41 | 1.2 | 954 | 2329 | 2.2 | 1133 |
| Ex. 8 | 6.9 | 35.2 | 0.41 | 1.1 | 772 | 2261 | 1.9 | 1223 |
| Ex. 9 | 6.8 | 34.1 | 1.25 | 1.2 | 632 | 2345 | 2.1 | 1321 |
| Ex. 10 | 7.1 | 31.2 | 0.40 | 1.2 | 861 | 2230 | 2.4 | 1195 |
| Ex. 11 | 6.4 | 45.7 | 0.51 | 1.1 | 712 | 2475 | 1.4 | 1598 |
| Comp. 1 | 6.5 | 60.3 | 0.43 | 1.3 | 860 | 2124 | 0.3 | 1074 |
| Comp. 2 | 9.2 | 24.8 | 0.44 | 1.0 | 710 | 2095 | 2.6 | 1023 |
| Comp. 3 | 22.1 | 35.6 | 0.48 | 1.5 | 765 | 2071 | 2.5 | 1054 |
| Comp. 4 | 23.5 | 35.2 | 0.45 | 1.2 | 785 | 2143 | 2.3 | 1196 |
| Comp. 5 | 8.4 | 35.8 | 2.22 | 1.1 | 923 | 2159 | 2.3 | 1113 |
| Comp. 6 | 6.8 | 33.1 | 0.31 | 1.1 | 862 | 2180 | 2.6 | 1203 |
| Comp. 7 | 7.6 | 18.8 | 0.34 | 1.4 | 545 | 2174 | 2.5 | 1385 |
| Comp. 8 | 7.0 | 33.1 | 0.45 | 0.8 | 1620 | 2355 | 1.9 | 960 |

Underlines indicate that they are outside the scope of the present invention.

As shown in Table 3, each of the austenitic stainless steel sheets of Examples 1 to 11 had the higher tensile strength (TS), higher elongation at break (EL), and higher fold number. Therefore, it was found that the above austenitic stainless steel sheets had higher strength and improved fatigue properties.

On the other hand, the austenitic stainless steel sheet of Comparative Example 1 had the excessively low Si and Mo contents and the excessively high Cr content, so that the $Md_{30}$ value became too large. As a result, the TS, EL, and fold number were decreased.

The austenitic stainless steel sheet of Comparative Example 2 had the excessively high Si and Cu contents, so that the $Md_{30}$ value became too small. As a result, the TS and the fold number were decreased.

The austenitic stainless steel sheets of Comparative Examples 3 and 4 had the smaller number of stages in the intermediate rolling annealing step, so that the thickness and the average grain size became larger. As a result, the TS and the fold number were decreased.

The austenitic stainless steel sheet of Comparative Example 5 had the excessively low B value in the aging treatment step, so that the TS was decreased.

The austenitic stainless steel sheet of Comparative Example 6 had the excessively high B value in the aging treatment step, so that the dislocation density of the γ phase became lower. As a result, the TS was decreased. The austenitic stainless steel sheet of Comparative Example 7 had the excessively low reduction in thickness in the temper rolling step, so that the content of the M phase and the dislocation density of the γ phase were lower. As a result, the TS was decreased.

The austenitic stainless steel sheet of Comparative Example 8 had the excessively high O content, leading to a larger number of inclusions. As a result, the fold number was decreased.

As can be seen from the above results, according to the present invention, it is possible to provide an austenitic stainless steel sheet which has high strength even if it has a small thickness, and which has improved fatigue properties, and to provide a method for producing the same.

Also, according to the present invention, it is possible to provide a sheet spring which has high strength even if it has a small thickness, and which has a long life.

Moreover, based on the above results, the present invention can be the following aspects:

[1]

An austenitic stainless steel sheet, wherein the austenitic stainless steel sheet comprises, on a mass basis, C: 0.04 to 0.11%, Si: 2.0 to 3.5%, Mn: 1.50% or less, Ni: 6.0 to 10.0%, Cr: 12.0 to 15.0%, Mo: 1.3 to 3.2%, Cu: 1.00% or less, N: 0.03 to 0.15%, and O: 0.0050% or less, the balance being Fe and impurities;

wherein the austenitic stainless steel sheet has a value of $Md_{30}$ of −30.0 to 0° C., wherein the value of $Md_{30}$ is represented by the following equation (1):

$$Md_{30} = 551 - 462(C + N) - 9.2Si - 8.1Mn - 29(Ni + Cu) - 13.7Cr - 18.5Mo \quad (1)$$

in which the symbols of the elements each represents a content (% by mass) of each element;

wherein the austenitic stainless steel sheet has a metallographic structure having a content of a strain-induced martensite phase of 30% by volume or more; and wherein the austenitic stainless steel sheet has a thickness of 0.15 mm or less.

[2]

The austenitic stainless steel sheet according to [1], further comprising, on a mass basis, one or more selected from Co: 0.05 to 0.50%, Al: 0.15% or less, V: 0.0001 to 0.5000%, Ti: 0.01 to 0.50%, B: 0.0001 to 0.0150%, Nb: 0.001 to 0.100%, Mg: 0.0001 to 0.0030%, Ca: 0.0003 to 0.0100%, Sn: 0.001 to 0.500%, Pb: 0.0001 to 0.0100%, W: 0.0001 to 0.5000%, Zr: 0.0001 to 0.1000%, and REM: 0.0001 to 0.3000%.

[3]

The austenitic stainless steel sheet according to [1] or [2], wherein the austenitic stainless steel sheet has an average crystal grain size of 15.0 μm or less.

[4]

The austenitic stainless steel sheet according to any one of [1] to [3], wherein a dislocation density of retained austenite phases is $0.40\times10^{16}$ $m^{-2}$ or more.

[5]

The austenitic stainless steel sheet according to any one of [1] to [4], wherein the austenitic stainless steel sheet comprises inclusions having an average diameter of 1.5 μm or less.

[6]

The austenitic stainless steel sheet according to [5], wherein the number of inclusions is 1000 inclusions/$mm^2$ or less.

[7]

The austenitic stainless steel sheet according to any one of [1] to [6], wherein the austenitic stainless steel sheet has a tensile strength (TS) of 2200 MPa or more.

[8]

The austenitic stainless steel sheet according to any one of [1] to [7], wherein the austenitic stainless steel sheet has an elongation at break (EL) of 0.5% or more.

[9]

The austenitic stainless steel sheet according to any one of [1] to [8], wherein the austenitic stainless steel sheet has a fold number of 1100 or more, as measured in accordance with JIS P 8115: 2001.

[10]

A method for producing an austenitic stainless steel sheet, the method comprising:

an intermediate rolling annealing step of subjecting a hot-rolled annealed sheet to stages of sequential cold rolling and annealing, the stages being repeated two or more times, wherein the hot-rolled annealed sheet has a composition comprising, on a mass basis, C: 0.04 to 0.11%, Si: 2.0 to 3.5%, Mn: 1.50% or less, Ni: 6.0 to 10.0%, Cr: 12.0 to 15.0%, Mo: 1.3 to 3.2%, Cu: 1.00% or less, N: 0.03 to 0.15%, and O: 0.0050% or less, the balance being Fe and impurities, wherein the hot-rolled annealed sheet has a value of $Md_{30}$ of −30.0 to 0° C., and wherein the value of $Md_{30}$ is represented by the following equation (1):

$$Md_{30} = 551 - 462(C + N) - 9.2Si - 8.1Mn - 29(Ni + Cu) - 13.7Cr - 18.5Mo \quad (1)$$

in which the symbols of the elements each represents a content (% by mass) of each element; and a temper rolling step of subjecting a cold-rolled annealed sheet obtained in the intermediate rolling annealing step to temper rolling at a reduction in thickness of 60% or more to adjust a thickness to 0.15 mm or less; and an aging step of subjecting a temper-rolled sheet obtained in the temper rolling step under a condition where a value of B is 11500 to 15000, wherein the B is represented by the following equation (2):

$$B = T(\log t + 20) \quad (2)$$

in which T is a temperature (K) and t is a time (h).

[11]

The method for producing an austenitic stainless steel sheet according to [10], wherein the hot-rolled annealed sheet further comprises, on a mass basis, one or more selected from Co: 0.05 to 0.50%, Al: 0.15% or less, V: 0.0001 to 0.5000%, Ti: 0.01 to 0.50%, B: 0.0001 to 0.0150%, Nb: 0.001 to 0.100%, Mg: 0.0001 to 0.0030%, Ca: 0.0003 to 0.0100%, Sn: 0.001 to 0.500%, Pb: 0.0001 to 0.0100%, W: 0.0001 to 0.5000%, Zr: 0.0001 to 0.1000%, and REM: 0.0001 to 0.3000%.

[12]

The method for producing an austenitic stainless steel sheet according to [10] or [11], wherein each reduction in thickness in the cold rolling performed twice or more in the intermediate rolling annealing step is 50% or more.

[13]

The method for producing an austenitic stainless steel sheet according to any one of [10] to [12], wherein an aging time in the aging treatment step is 5 to 500 seconds.

A sheet spring comprising the austenitic stainless steel plate according to any one of [1] to [9].

The invention claimed is:

1. An austenitic stainless steel sheet, wherein the austenitic stainless steel sheet comprises, on a mass basis, C: 0.04 to 0.11%, Si: 2.0 to 3.5%, Mn: 1.50% or less, Ni: 6.0 to 10.0%, Cr: 12.0 to 15.0%, Mo: 1.3 to 3.2%, Cu: 1.00% or less, N: 0.03 to 0.15%, and O: 0.0050% or less, the balance being Fe and impurities;

wherein the austenitic stainless steel sheet has a value of $Md_{30}$ of −30.0 to 0° C., wherein the value of $Md_{30}$ is represented by the following equation (1):

$$Md_{30} = 551 - 462(C + N) - 9.2Si - 8.1Mn - 29(Ni + Cu) - 13.7Cr - 18.5Mo \quad (1)$$

in which the symbols of the elements each represents a content in % by mass of each element;

wherein the austenitic stainless steel sheet has a metallographic structure having a content of a strain-induced martensite phase of 30% by volume or more; and wherein the austenitic stainless steel sheet has a thickness of 0.15 mm or less, wherein the austenitic stainless steel sheet has a tensile strength (TS) of 2200 MPa or more, wherein the austenitic stainless steel sheet has a fold number of 1100 or more, as measured in accordance with JIS P 8115:2001.

2. The austenitic stainless steel sheet according to claim 1, further comprising, on a mass basis, one or more selected from Co: 0.05 to 0.50%, Al: 0.15% or less, V: 0.0001 to 0.5000%, Ti: 0.01 to 0.50%, B: 0.0001 to 0.0150%, Nb: 0.001 to 0.100%, Mg: 0.0001 to 0.0030%, Ca: 0.0003 to 0.0100%, Sn: 0.001 to 0.500%, Pb: 0.0001 to 0.0100%, W: 0.0001 to 0.5000%, Zr: 0.0001 to 0.1000%, and REM: 0.0001 to 0.3000%.

3. The austenitic stainless steel sheet according to claim 1, wherein the austenitic stainless steel sheet has an average crystal grain size of 15.0 μm or less.

4. The austenitic stainless steel sheet according to claim 1, wherein a dislocation density of retained austenite phases is $0.40\times10^{16}$ $m^{-2}$ or more.

5. The austenitic stainless steel sheet according to claim 1, wherein the austenitic stainless steel sheet has an elongation at break (EL) of 0.5% or more.

6. The austenitic stainless steel sheet according to claim 2, wherein the austenitic stainless steel sheet has an average crystal grain size of 15.0 μm or less.

7. The austenitic stainless steel sheet according to claim 2, wherein a dislocation density of retained austenite phases is $0.40\times10^{16}$ $m^{-2}$ or more.

8. The austenitic stainless steel sheet according to claim 2, wherein the austenitic stainless steel sheet has an elongation at break (EL) of 0.5% or more.

9. A sheet spring comprising the austenitic stainless steel plate according to claim 1.

* * * * *